US008118621B2

(12) United States Patent
Fukase

(10) Patent No.: US 8,118,621 B2
(45) Date of Patent: Feb. 21, 2012

(54) CONNECTION TERMINAL

(75) Inventor: Yoshihiro Fukase, Makinohara (JP)

(73) Assignee: Yazaki Corporation, Tokyo (JP)

( * ) Notice: Subject to any disclaimer, the term of this patent is extended or adjusted under 35 U.S.C. 154(b) by 27 days.

(21) Appl. No.: 12/705,125

(22) Filed: Feb. 12, 2010

(65) Prior Publication Data

US 2010/0210148 A1 Aug. 19, 2010

(30) Foreign Application Priority Data

Feb. 13, 2009 (JP) ..... P.2009-031399

(51) Int. Cl.
*H01R 11/22* (2006.01)

(52) U.S. Cl. ..... 439/852

(58) Field of Classification Search ..... 439/852, 439/862, 741, 851, 587, 581
See application file for complete search history.

(56) References Cited

U.S. PATENT DOCUMENTS 5,643,018 A * 7/1997 Sakai et al. ..... 439/852
5,941,741 A * 8/1999 Dobbelaere et al. ..... 439/852
6,042,433 A * 3/2000 Chen ..... 439/852
6,152,788 A * 11/2000 Hata et al. ..... 439/852
7,252,564 B1 * 8/2007 Morello et al. ..... 439/877
2002/0077001 A1 * 6/2002 Chen ..... 439/852

FOREIGN PATENT DOCUMENTS

JP 2007-280825 10/2007

* cited by examiner

*Primary Examiner* — Alexander Gilman
(74) *Attorney, Agent, or Firm* — Finnegan, Henderson, Farabow, Garrett & Dunner, L.L.P.

(57) ABSTRACT

A connection terminal includes a terminal connection portion, a wire connection portion and a neck portion. The terminal connection portion has a tubular part surrounded by a first wall, a second wall opposing the first wall and side walls connecting the first wall and second wall. The tubular part accommodates and is electrically connected to a mating terminal. The wire connection portion engages a wire. The neck portion is disposed between the terminal connection portion and the wire connection portion and has a third wall extended from the first wall and standing walls standing on the third wall. The standing walls are extended from the side walls respectively and oppose each other. A distance between the standing walls is decreased according to an extending direction in which the third wall is extended from the first wall. The neck portion is electrically connected to the wire connection portion. An end of the second wall is protruded in the extending direction than connecting parts of the side walls where the standing walls are connected.

7 Claims, 8 Drawing Sheets

CONNECTION TERMINAL

BACKGROUND

This invention relates to a connection terminal having a neck portion formed between a terminal connection portion and a wire connection portion.

Patent Document 1 discloses a conventional connection terminal. As shown in FIGS. 8 and 9, this conventional connection terminal 100 includes a terminal connection portion 101 for the connection of a mating terminal thereto, a wire connection portion 110 having a wire accommodating space 112 and adapted to be connected to a wire (not shown) disposed in the wire accommodating space 112, and a neck portion 120 disposed between the terminal connection portion 101 and the wire connection portion 110. This connection terminal 100 is formed by bending a single electrically-conductive sheet into a predetermined shape.

The terminal connection portion 101 includes a tubular portion 102 defined by a lower wall 102*a*, opposite side walls 102*b* and an upper wall 102*c*. A resilient contact piece portion 102*d* is provided within the tubular portion 102. When the mating terminal is inserted into the tubular portion 102, this mating terminal is held in intimate contact with the tubular portion 102 by a reaction force resulting from resilient deformation of the resilient contact piece portion 102*d*. A rear edge of the upper wall 102*c* of the tubular portion 102 serves as a lance engagement portion 103. The connection terminal 100 is accommodated in a terminal accommodating chamber of a connector housing (not shown), and a lance provided within the terminal receiving chamber is engaged with the lance engagement portion 103, thereby fixing the connection terminal 100 relative to the connector housing.

The wire connection portion 110 has a surrounding wall 111 of a generally U-shaped cross-section extending continuously from a lower wall 121*a* and opposite side walls 121*b* of the neck portion 120, and the wire accommodating space 112 is defined by this surrounding wall 111. A pair of first wire press-fastening portions 113, as well as a pair of second wire press-fastening portions 114, are formed on and project respectively from upper edges of the U-shaped surrounding wall 111. The pair of first wire press-fastening portions 113 are press-fastened onto an exposed portion of a conductor of the wire (not shown) to be fixed thereto, while the pair of second wire press-fastening portions 114 are press-fastened onto a sheath of the wire to be fixed to the wire.

The neck portion 120 includes the lower wall 121*a* extending continuously from the lower wall 102*a* of the terminal connection portion 101, and the opposite side walls 121*b* extending continuously respectively from the opposite side walls 102*b* of the terminal connection portion 101. The neck portion 120 is formed such that a width W12 of the neck portion 120 between the opposite side walls 121*b* is decreasing gradually toward the wire connection portion 110.

Namely, in order that the wire connection portion 110, when press-fastened onto the wire, can firmly fix the wire (not shown), it is preferred that the width of the wire accommodating space 112 should be formed into a dimension corresponding to the width of the wire. Therefore, by the provision of the neck portion 120, a width W10 at the tubular portion 102 of the terminal connection portion 101 is reduced or narrowed down into a width W11 at the wire connection portion 110.

[Patent Document] Japanese Patent Publication No. 2007-280825 A

However, in the case where the connection terminal 100 is designed to meet a small-diameter design of the wire (not shown), so that the difference between the width W10 of the tubular portion 102 of the terminal connection portion 101 and the width W11 of the wire connection portion 110 is large, the rate of gradual decrease of a width W12 of the neck portion 120 increases, and therefore a crack or the like is liable to be produced in the connection terminal 100 by a bending force applied during a press-shaping operation for forming the connection terminal 100, thus causing a so-called terminal crack.

Here, in order to prevent such terminal crack, it may be proposed to increase a length L11 (see FIG. 9) of the neck portion 120. In this case, however, the overall length L10 of the connection terminal 100 is increased because of the increased length of the neck portion 120. When the connection terminal 100 is thus increased in size, there arise problems such as an increased cost of the material for the connection terminal 100, an increased size of the connector housing for accommodating the connection terminal and an increased cost of the material for the connector housing.

SUMMARY

It is therefore one advantageous aspect of the present invention is to provide a connection terminal in which even when the connection terminal is designed to meet a small-diameter design of a wire, an overall length of the connection terminal does not need to be increased, and also a terminal crack developing during the manufacture can be prevented.

C1.

According to one aspect of the invention, there is provided a connection terminal, comprising:

a terminal connection portion having a tubular part surrounded by a first wall, a second wall opposing the first wall and side walls connecting the first wall and second wall, the tubular part configured to accommodate and to be electrically connected to a mating terminal;

a wire connection portion configured to engage a wire;

a neck portion disposed between the terminal connection portion and the wire connection portion and having a third wall extended from the first wall and standing walls standing on the third wall, the standing walls extended from the side walls respectively and opposing each other, a distance between the standing walls decreased according to an extending direction in which the third wall is extended from the first wall, the neck portion electrically connected to the wire connection portion;

wherein an end of the second wall is protruded in the extending direction than connecting parts of the side walls where the standing walls are connected.

The connection terminal may be configured such that the terminal connection portion, the neck portion and the wire connection portion are formed by a single sheet made of a conductive material.

The connection terminal may be configured such that the wire connection portion has a bent wall extended from the third wall and the standing walls and defining a space in which the wire is disposed.

The connection terminal may be configured such that the end of the second wall serves as a lance engagement member configured to be engaged with a lance of a connector housing.

The connection terminal may be configured such that: the end of the second wall is connected to the connecting parts by end edges of the side walls; and a distance between the end edges and the second wall is decreased according to the extending direction.

The connection terminal may be configured such that the second wall is connected to the connecting parts by end edges of the side walls which are orthogonal to the extending direction.

The connection terminal may be configured such that corners which connect upper faces of the standing walls opposite to the third wall and end faces of the side walls connecting the second wall to the connecting part are rounded.

DETAILED DESCRIPTION OF EXEMPLIFIED EMBODIMENTS

Figure 1:
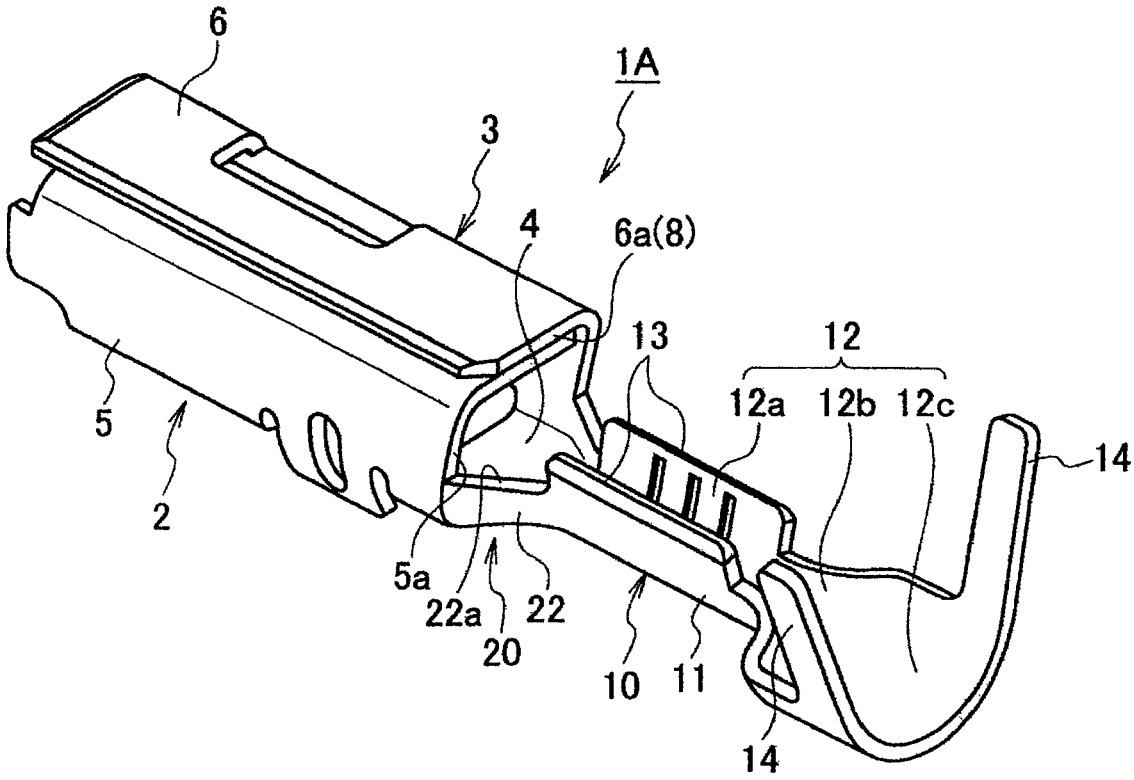
FIG. 1 is a perspective view of a first embodiment of a connection terminal according to the present invention.
Figure 2:
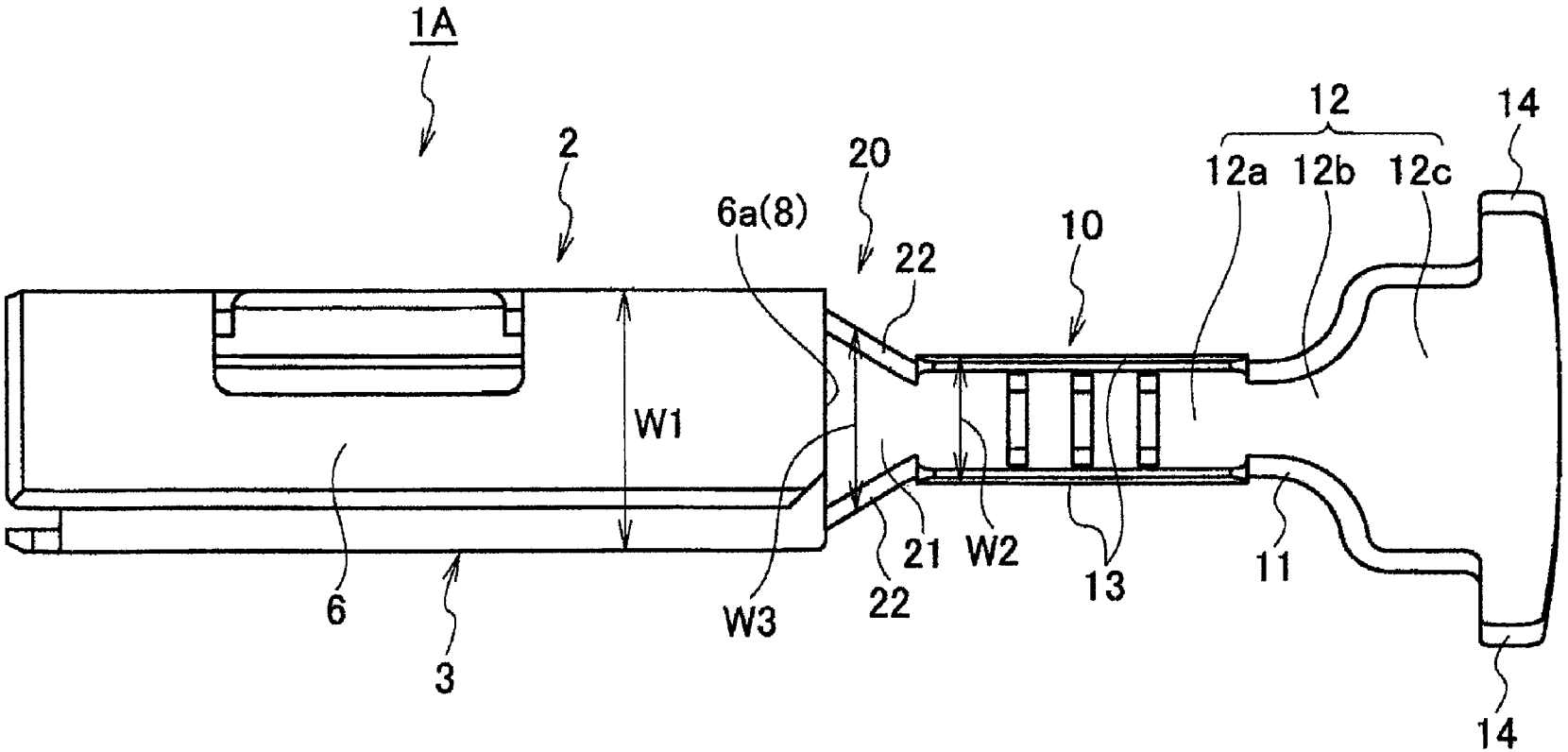
FIG. 2 is a plan view of the connection terminal of the first embodiment.

Exemplified embodiments of the invention are described below in detail with reference to the accompanying drawings.

First Embodiment

As shown in FIGS. 1 to 4, the connection terminal 1A includes a terminal connection portion 2 for the connection of a mating terminal (not shown) thereto, a wire connection portion 10 having a wire accommodating space 12 and adapted to be connected to a wire received in the wire accommodating space 12, and a neck portion 20 disposed between the terminal connection portion 2 and the wire connection portion 10. This connection terminal 1A is formed by bending a single electrically-conductive sheet into a predetermined shape.

The terminal connection portion 2 includes a tubular portion 3 defined by a lower wall 4 (a first wall), opposite side walls 5 and an upper wall 6 (a second wall). A resilient contact piece portion 7 is provided within the tubular part 3. When the mating terminal is inserted into the tubular part 3, this mating terminal is held in intimate contact with the tubular part 3 by a restoring force of the resiliently-deformed resilient contact piece portion 7 and therefore is electrically connected to the connection terminal 1A. A rear end 6*a* of the upper wall 6 of the tubular part 3 disposed adjacent to the neck portion 20 serves as a lance engagement member 8. The connection terminal 1A is accommodated in a terminal accommodating chamber of a connector housing (not shown), and a lance provided within the terminal accommodating chamber is engaged with the lance engagement member 8, thereby fixing the connection terminal 1A relative to the connector housing.

The neck portion 20 includes a lower wall 21 (a third wall) extending continuously from the lower wall 4 of the tubular part 3, and opposite side walls 22 (standing walls) extending continuously respectively from the opposite side walls 5 of the terminal connection portion 2. The neck portion 20 is formed such that a width W3 of the neck portion 20 between the opposite side walls 22 is decreasing gradually toward the wire connection portion 10. A width of an end of the neck portion 20 on a side of the terminal connection portion 2 (a front end) is equal to a width W1 of the terminal connection portion 2, and a width of an end of the neck portion 20 on a side of the wire connection portion 10 (a rear end) is equal to a width W2 of the wire connection portion 10 (more specifically, that portion of a surrounding wall 11 (a bent wall) defining a narrow space portion 12*a*).

The wire connection portion 10 has the surrounding wall 11 of a generally U-shaped cross-section extending continuously from the lower wall 21 and opposite side walls 22 of the neck portion 20, and the wire accommodating space 12 is defined by this surrounding wall 11. The wire accommodating space 12 includes the narrow space portion 12*a*, a spreading space portion 12*b* extending continuously from a rear end of the narrow space portion 12*a* and increasing gradually in width (or diameter) away from the rear end of the narrow space portion 12*a*, and a wide space portion 12*c* extending continuously from a rear end of the spreading space portion 12*b*. A pair of first wire press-fastening portions 13 are formed on and project respectively from upper edges of opposite wall portions of that portion of the surrounding wall 11 defining the narrow space portion 12*a*. A pair of second wire press-fastening portions 14 are formed on and project respectively from upper edges of opposite wall portions of that portion of the surrounding wall 11 defining the wide space portion 12*c*. The pair of first wire press-fastening portions 13 are press-fastened onto an exposed portion of a conductor of the wire to be fixed thereto, while the pair of second wire press-fastening portions 14 are press-fastened onto a sheath of the wire to be fixed to the wire.

The opposite side walls 5 of the tubular part 3 are formed such that the front end of the neck portion 20 is disposed forwardly of the rear end 6*a* of the upper wall 6 of the tubular part 3. In other words, the rear end 6*a* of the upper wall 6 is protruded on a side of the neck portion 20 than connecting parts of the opposite side walls 5 where the opposite side walls 22 are connected. Mores specifically, rear ends 5*a* of the opposite side walls 5 of the tubular part 3 are formed respectively as slanting surfaces slanting forwardly toward the lower wall 4 from the upper wall 6.

Figure 5:
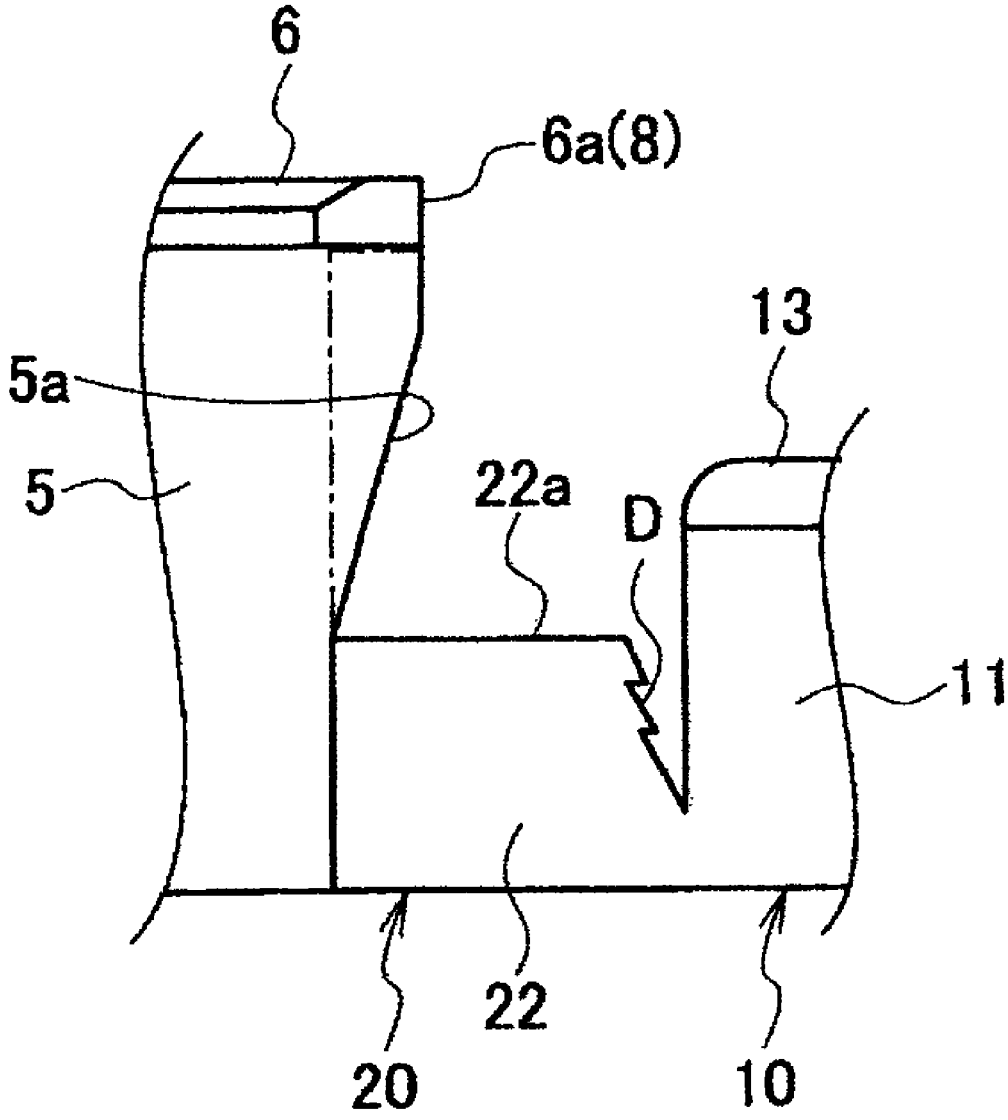
FIG. 5 is an extended side-elevational view of the connection terminal of the first embodiment, in a condition where a terminal crack develops.

Therefore, when the overall length of the connection terminal 1A is represented by L, the length of the terminal connection portion 2 is represented by L1, and the length of the neck portion 20 is represented by L2, the longitudinal region of the neck portion 20 and the longitudinal region of the terminal connection portion 20 overlap each other, and the length L2 of the neck portion 20 is substantially increased without increasing the overall length L of the connection terminal 1A. Therefore, the width W2 of the wire accommodating space 12 (more specifically, the narrow space portion 12*a*) of the wire connection portion 10 can be decreased without increasing the rate of gradual decrease of the width W3 of the neck portion 20. Therefore, a crack D (as shown in FIG. 5) or the like will not be produced in the connection terminal 1A by a bending force applied during a press-shaping operation, and therefore such a so-called terminal crack will not develop. With this construction, even when the connection terminal 1A is designed to meet a small-diameter design of the wire, the overall length L of the connection terminal 1A does not need to be increased, and besides a terminal crack developing during the manufacture can be prevented.

In this embodiment, the rear end 6*a* of the upper wall 6 of the tubular part 3 disposed adjacent to the neck portion 20 serves as the lance engagement member 8 with which the lance of the connector housing (not shown) is adapted to be engaged. Therefore, the position of the rear end 6*a* of the tubular part 3 disposed adjacent to the neck portion 20, that is, the position of the lance engagement member 8, is not changed, and therefore the construction of the connector housing also does not need to be changed.

In this first embodiment, the rear ends 5*a* of the opposite side walls 5 of the tubular part 3 are formed respectively as the slanting surfaces slanting forwardly downwardly. Therefore, the upper wall 6 of the tubular part 3 of the terminal connection portion 2 is supported by the opposite side walls 5 as far as its rear end, and therefore the strength of the lance engagement member 8 is not reduced.

Further, the tubular part 3 can be constructed so that the opposite side walls 5 of the tubular part are not much notched, and therefore the strength of the lance engagement member 8 is prevented from being reduced.

Figure 3:
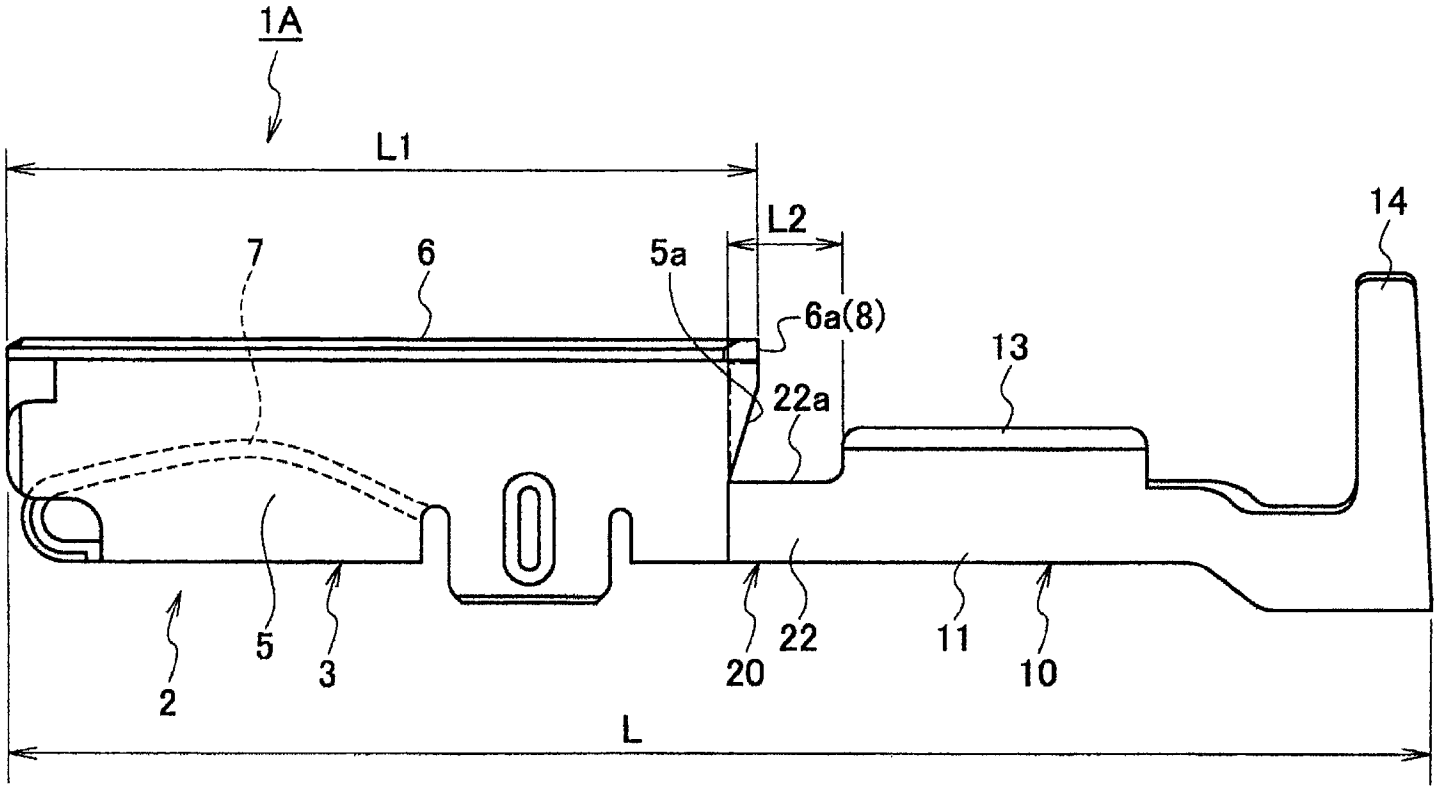
FIG. 3 is a side-elevational view of the connection terminal of the first embodiment.
Figure 4:
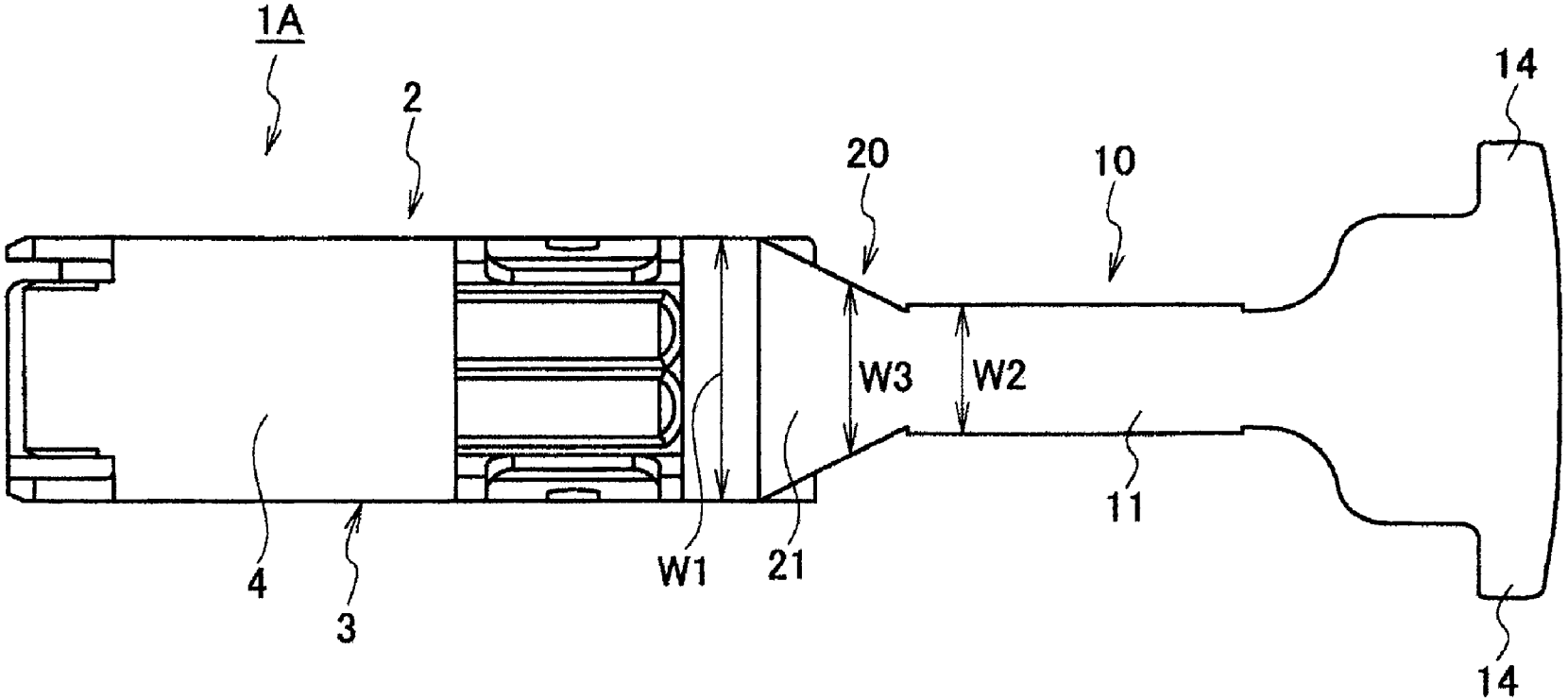
FIG. 4 is a bottom view of the connection terminal of the first embodiment.

In the case where the lance engagement member 8 has a sufficient strength, the rear end portions of the opposite side walls 5 may be notched as indicated in long dashed short dashed lines in FIGS. 3 and 5.

Second Embodiment

Figure 6:
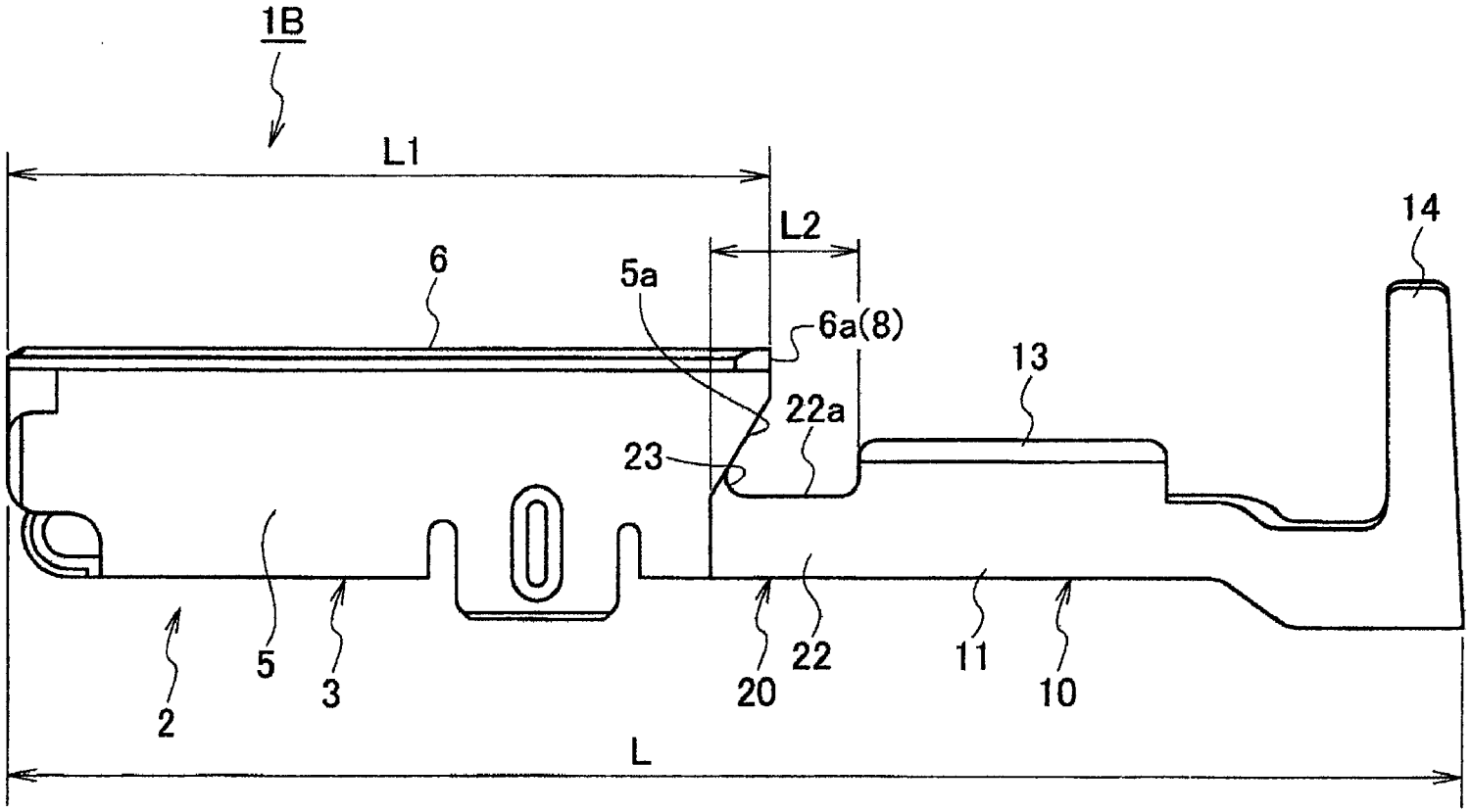
FIG. 6 is a side-elevational view of a second embodiment of a connection terminal according to the present invention.

As shown in FIG. 6, the connection terminal 1B of this second embodiment differs from the connection terminal 1A of the first embodiment only in that a corner portion into which a rear end 5*a* of each of opposite side walls 5 of a tubular part 3 of a tubular part 3 and an upper edge 22*a* of a corresponding one of opposite side walls 22 of a neck portion 20 merge is formed into an arcuate surface 23. The other construction of the connection terminal 1B is similar to that of the connection terminal 1A, and therefore explanation thereof will be omitted here, and those portions identical respectively to the corresponding portions of the connection terminal 1A will be designated by identical reference numerals, respectively.

In this second embodiment, also, similar advantageous effects to the first embodiment can be obtained.

Figure 7:
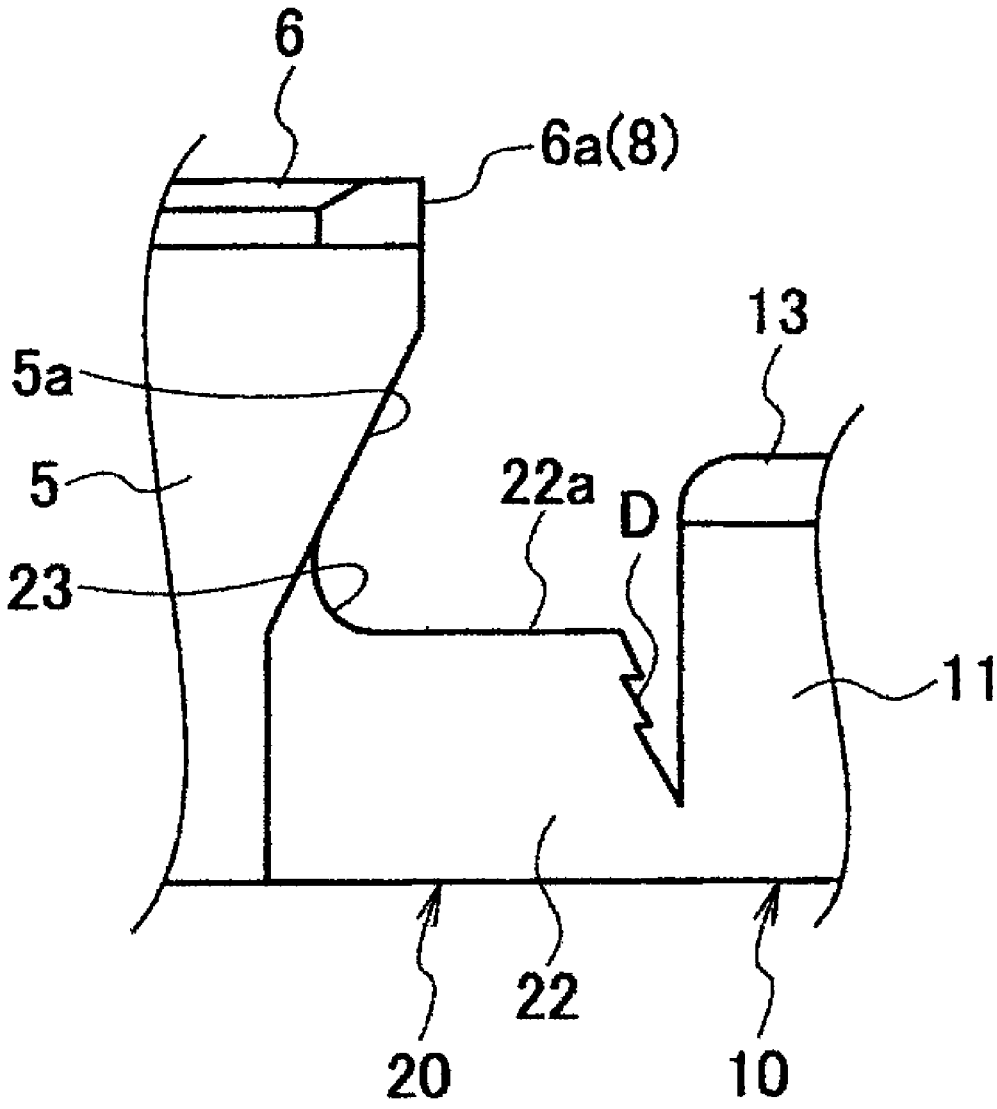
FIG. 7 is an extended side-elevational view of the connection terminal of the second embodiment, in a condition where a terminal crack develops.
Figure 8:
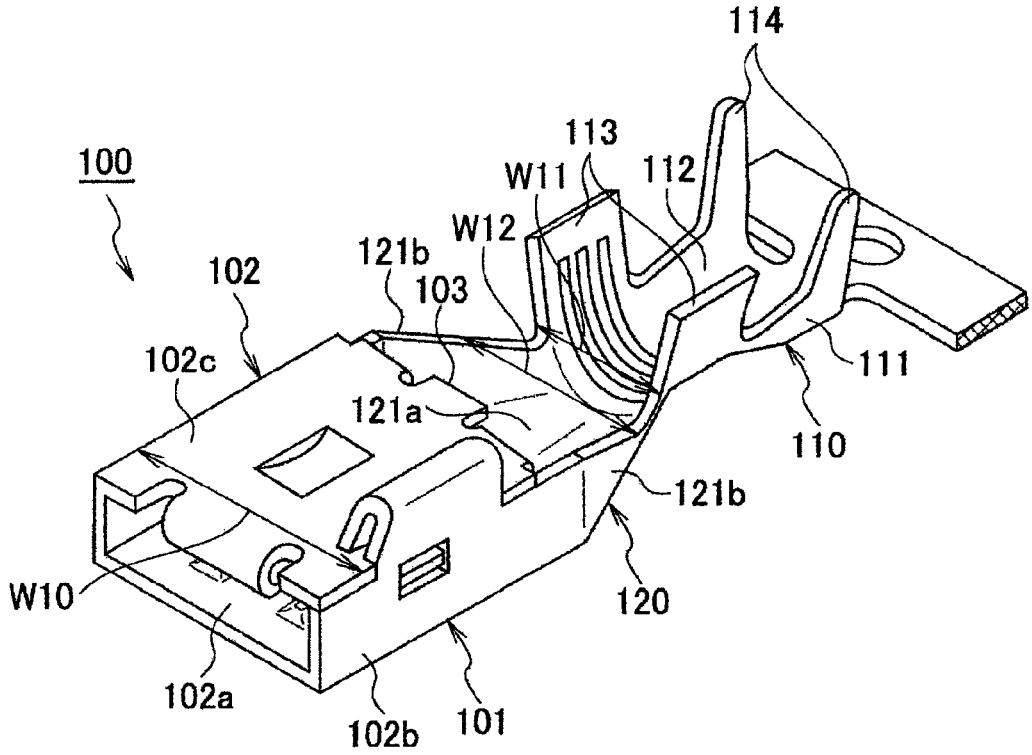
FIG. 8 is a perspective view of a conventional connection terminal.
Figure 9:
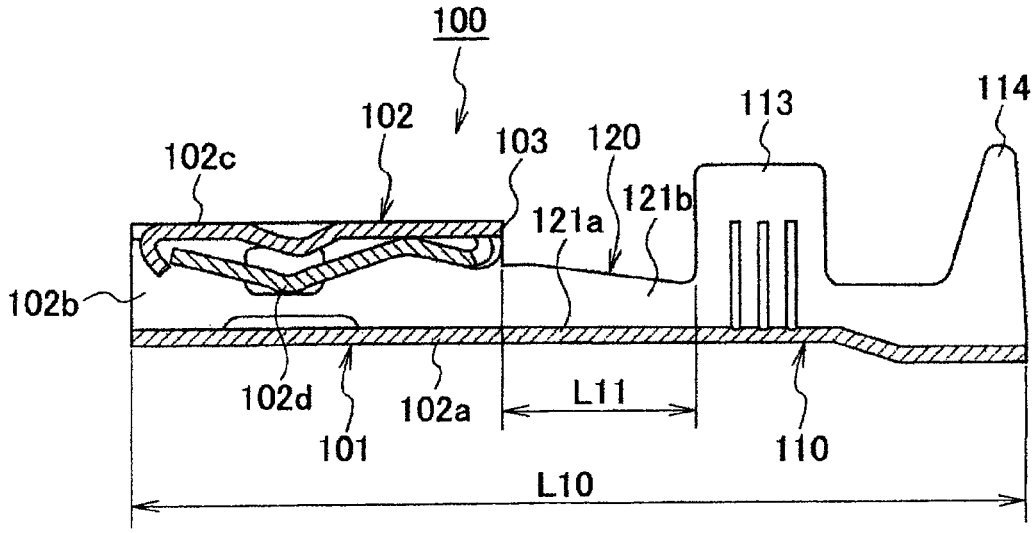
FIG. 9 is a cross-sectional view of the conventional connection terminal.

In this second embodiment, the angle of the corner portion into which the rear end 5*a* of each side wall 5 of the tubular part 3 of the terminal connection portion 2 and the upper edge 22*a* of the corresponding side wall 22 of the neck portion 20 merge is not acute, is rounded for example, and therefore the concentration of stresses on this corner portion can be prevented. Therefore, a crack D (as shown in FIG. 7) or the like is more positively prevented from developing in the connection terminal.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

The disclosures of Japanese Patent Application No. 2009-031399 filed Feb. 13, 2009 including specification, drawings and claims is incorporated herein by reference in its entirety.

What is claimed is:

1. A connection terminal, comprising:

a terminal connection portion having a tubular part surrounded by a first wall, a second wall opposing the first wall and side walls connecting the first wall and second wall, the tubular part configured to accommodate and to be electrically connected to a mating terminal;

a wire connection portion configured to engage a wire; and a neck portion disposed between the terminal connection portion and the wire connection portion and having a third wall extended from the first wall and standing walls standing on the third wall, the standing walls extended from the side walls respectively and opposing each other, a distance between the standing walls decreased according to an extending direction in which the third wall is extended from the first wall, the neck portion electrically connected to the wire connection portion;

wherein an end of the second wall is protruded in the extending direction than connecting parts of the side walls where the standing walls are connected.

2. The connection terminal as set forth in claim 1, wherein:

the terminal connection portion, the neck portion and the wire connection portion are formed by a single sheet made of a conductive material.

3. The connection terminal as set forth in claim 1, wherein:

the wire connection portion has a bent wall extended from the third wall and the standing walls and defining a space in which the wire is disposed.

4. The connection terminal as set forth in claim 1, wherein:

the end of the second wall serves as a lance engagement member configured to be engaged with a lance of a connector housing.

5. The connection terminal as set forth in claim 1, wherein:

the side walls have end edges which connect the end of the protruded second wall to the connecting parts and are slanted with respect to the extending direction.

6. The connection terminal as set forth in claim 1, wherein:

the side walls have end edges which connect the second wall to the connecting parts and are orthogonal to the extending direction.

7. The connection terminal as set forth in claim 1, wherein:

corners which connect upper faces of the standing walls opposite to the third wall and end faces of the side walls connecting the second wall to the connecting part are rounded.

* * * * *